United States Patent [19]

Sala et al.

[11] 4,342,260

[45] Aug. 3, 1982

[54] APPARATUS FOR PRINTING FABRICS WITH A SCREEN PRINTING PROCESS

[76] Inventors: Enrico Sala, Via Emilia Ovest, 57, Fidenza (Parma); Rino Ricchetti, Via Lisoni, 6, Parma, both of Italy

[21] Appl. No.: 184,012

[22] Filed: Sep. 4, 1980

[30] Foreign Application Priority Data

Sep. 7, 1979 [IT] Italy ..... 25545 A/79

[51] Int. Cl.[3] ..... B05C 17/06; B05C 17/04

[52] U.S. Cl. ..... 101/126; 101/123

[58] Field of Search ..... 101/115, 123, 126

[56] References Cited

U.S. PATENT DOCUMENTS 2,485,289 10/1949 Jane ..... 101/126 X 2,690,118 9/1954 Schwartz ..... 101/123 X 4,084,504 4/1978 Fuchs ..... 101/126 X 4,099,460 7/1978 Bubley ..... 101/126 X

*Primary Examiner*—Edgar S. Burr

*Assistant Examiner*—A. Heinz

*Attorney, Agent, or Firm*—Holman & Stern

[57] ABSTRACT

An automatic apparatus for printing fabrics with a screen printing process, of the type provided with a plurality of printing screens which can be lowered and raised with respect to garment support means. Said support means comprise a plurality of forms mounted at intervals on a conveyor means which is stepwise advanceable so as to bring each form in succession opposite each printing screen.

2 Claims, 3 Drawing Figures

APPARATUS FOR PRINTING FABRICS WITH A SCREEN PRINTING PROCESS

BACKGROUND OF THE INVENTION

As is well known to persons skilled in this particular branch of the art, the screen printing of fabrics—whether they be in fabric pieces or finished garments—is carried out by as many printing screens as there are colours which compose the design and/or wording to be printed.

Each screen frame is covered with a gauze with photoengraved perforations which exactly reproduce the portion or portions of one colour of the design and/or wording.

The screen is placed on the fabric and a printing paste of the desired colour is repeatedly spread over the gauze by means of one or more squeegee blades so that, opposite the engravings, the underlying fabric remains printed as a consequence of the extrusion of the printing paste through them. The operation is repeated with all the screens prepared for the different colours composing the design and/or wording which, finally, remains impressed on the fabric.

Automatic machines for the screen printing of fabrics are known which comprise a conveyor belt which is caused to advance stepwise so as to bring each fabric piece or garment opposite the printing screens, which are supported one after the next above the conveyor belt. When the conveyor belt is stationary the screens are lowered onto their respective fabrics and the wheeled squeege blades are drawn to and fro so as to extrude the printing paste through the engravings on the gauze.

In the screen printing of fabrics one technical problem to be solved relates to the centering of the screen with respect to the piece or garment.

In the case of a fabric piece (i.e. a non-finished garment), the aforesaid problem is readily solved by making marks or providing reference means on the conveyor belt, by means of which marks or reference means the fabric piece can be immediately centered with respect to the printing screen. Furthermore, the belt is normally self-adhesive in order to keep the fabric firm during the printing operations.

In the case of a garment, however, for example a T-shirt or the like, the solution is not as simple as this: for the prime condition for a perfect centering of the garment in the desired position with respect to the printing screen is that the garment be placed on the conveyor belt with its parts, i.e. front and back, in a very exact reciprocal position of symmetry. In this case, moreover, the self-adhesive belt cannot keep the whole garment firm in that it can act only on one part of it, that is to say the front or the back.

The above problems are presently solved by using flat forms of wood, plastic or similar material, which are introduced into the garment before the printing process.

Although this system gives satisfactory results, it nevertheless has the serious drawback of requiring excessive manpower: two operators are in effect required, one upstream of the apparatus to place the forms into the garments and one downstream of the apparatus to remove them from the garments.

Additionally, the cost of purchasing and storing the forms is not negligible.

BRIEF SUMMARY OF THE INVENTION

The object of the present invention is to solve the aforesaid technical problems connected with the processes of screen printing of fabrics, in particular of finished garments having a front and a back.

To achieve this object the present invention proposes an automatic apparatus for printing fabrics, in particular finished garments, of the type provided with a plurality of printing screens which can be lowered and raised with respect to garment support means, characterized by the fact that said garment support means comprise a plurality of forms mounted in a distanced manner on a conveyor means which is stepwise advanceable, so as to bring each form in succession opposite each printing screen.

Another not inconsiderable technical problem to be solved in automatic machines comprising a conveyor belt moving below printing screens in side-by-side arrangement relates to the difficulty of gaining access to the lower side of the printing screen gauze, which has to be periodically cleaned by the operator.

Access to the lower side of the gauze is made difficult by the smallness of the space between the printing screen and the belt and between printing screens in side-by-side arrangement. This lack of space means that the operator has to work in extremely inconvenient positions of a kind such as to require him to perform acrobatic movements if the whole surface of the gauze is to be cleaned; as an alternative, the printing frames can be dismantled, with resulting lengthy down-times.

This last-mentioned problem is solved according to the invention by mounting both forms and printing screens in a radial disposition, carousel fashion, and by supporting the printing screens so that they can be raised from the periphery towards the centre of the carousel.

In this way, ample access space can be provided both between printing screens in side-by-side arrangement and between printing screens and forms for the cleaning of the gauze and for other servicing and/or repair operations.

BRIEF DESCRIPTION OF THE DRAWINGS

The structural and functional characteristics of the invention and its advantages over the known art will be made clearer by the following exemplifying description with reference to the attached drawings, in which.

Figure 1:
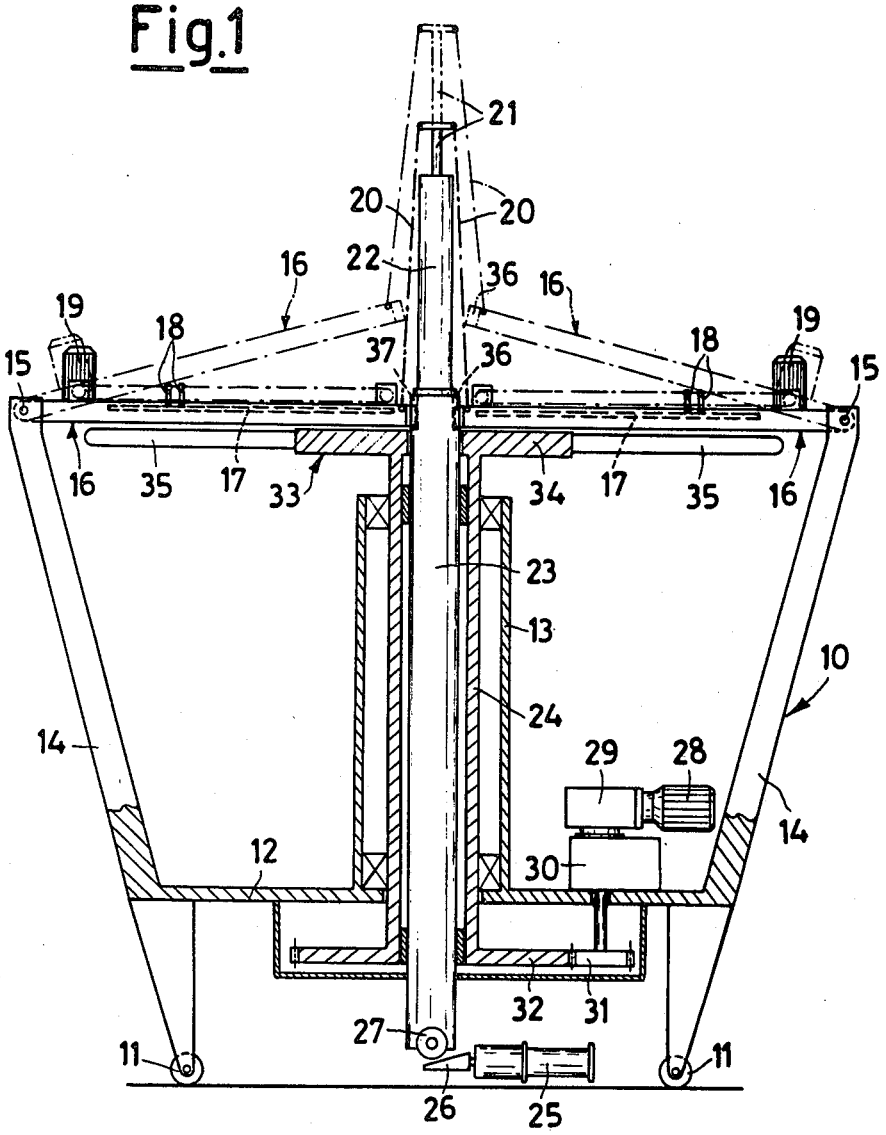
FIGS. 1 and 2 are two vertical section views which respectively illustrate the two operational positions of an apparatus embodied according to the invention.

With reference to the drawings the apparatus in question consists structurally of a frame 10 preferably, but not necessarily, mounted to wheels 11.

The frame 10 comprises a base 12 from which extend a stationary central column 13 and a plurality of peripheral uprights 14.

At the top of each upright 14 there is pivoted at 15 a related printing screen of a type per se known and indicated overall with the numeral 16. Each printing screen 16 comprises a removable gauze 17 run over by one or more squeegee blades 18 moved to-and-fro by a motor 19, through a chain transmission. At the end opposite 15, each printing screen 16 is connected, by a chain or similar means 20, to the free end of a stem 21 of a hydrodynamic cylinder 22. The cylinder 22 extends solidly from the top of a shaft 23 axially rotatable within a shell 24 which is in turn rotatably mounted within the stationary tubular column 13. The translation of the shaft 23 is controlled by a hydrodynamic cylinder 25 with causes a wedge-shaped cam 26 to act on an idle roller 27 at the lower end of the shaft 23.

The shell 24 is caused to rotate stepwise by a motor variator 28 through a speed reducer 29, an intermittent control 30, and a pair of gearwheels 31, 32.

The shell 24 controls the stepwise rotation of a carousel 33 consisting of a polygonal table 34, solid with the shell 24, on each side of which radially extend removable forms 35 into which the garment to be screen printed can be placed.

Figure 3:
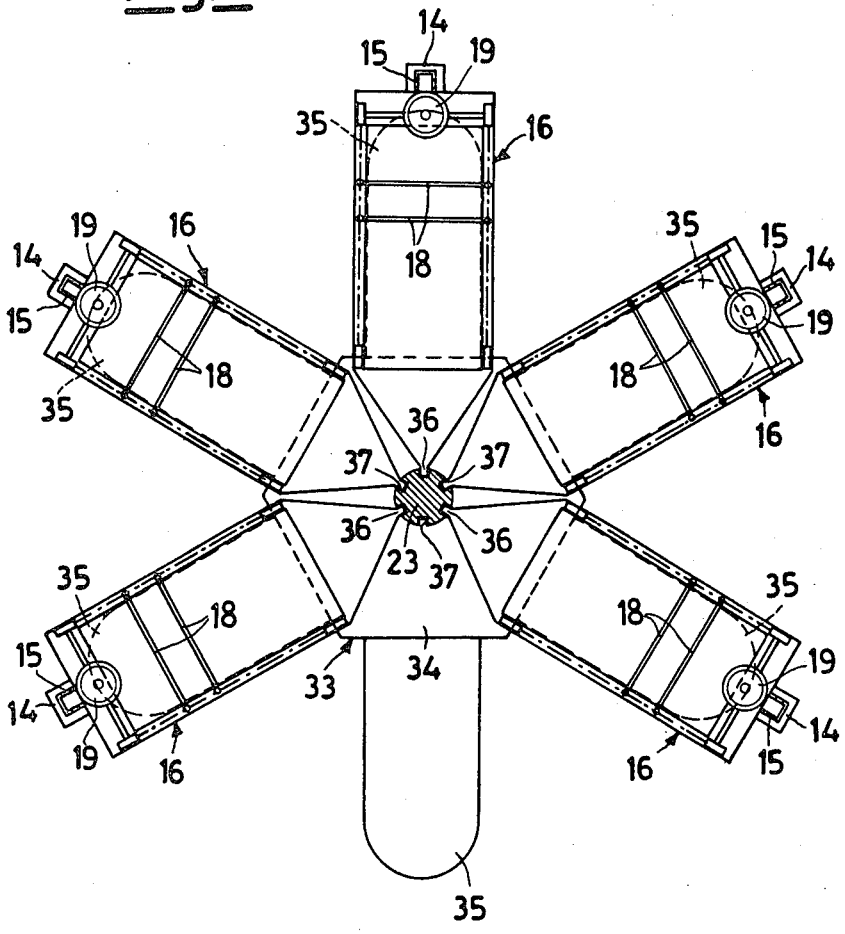
FIG. 3 is a plan view of the apparatus.

Provision is made for as many forms 35 as there are printing screens 16, with an extra one (FIG. 3) for the feeding and removal of the garments being printed, at a station without printing screen.

The operation of the apparatus according to the invention as described above is briefly the following.

When at rest, the machine has all the printing screens 16 in the wholly raised position as indicated with dashes and dots in FIG. 1. This position allows all servicing and/or repair of the machine, or the replacement of screens, to be carried out conveniently and with ample space.

Figure 2:
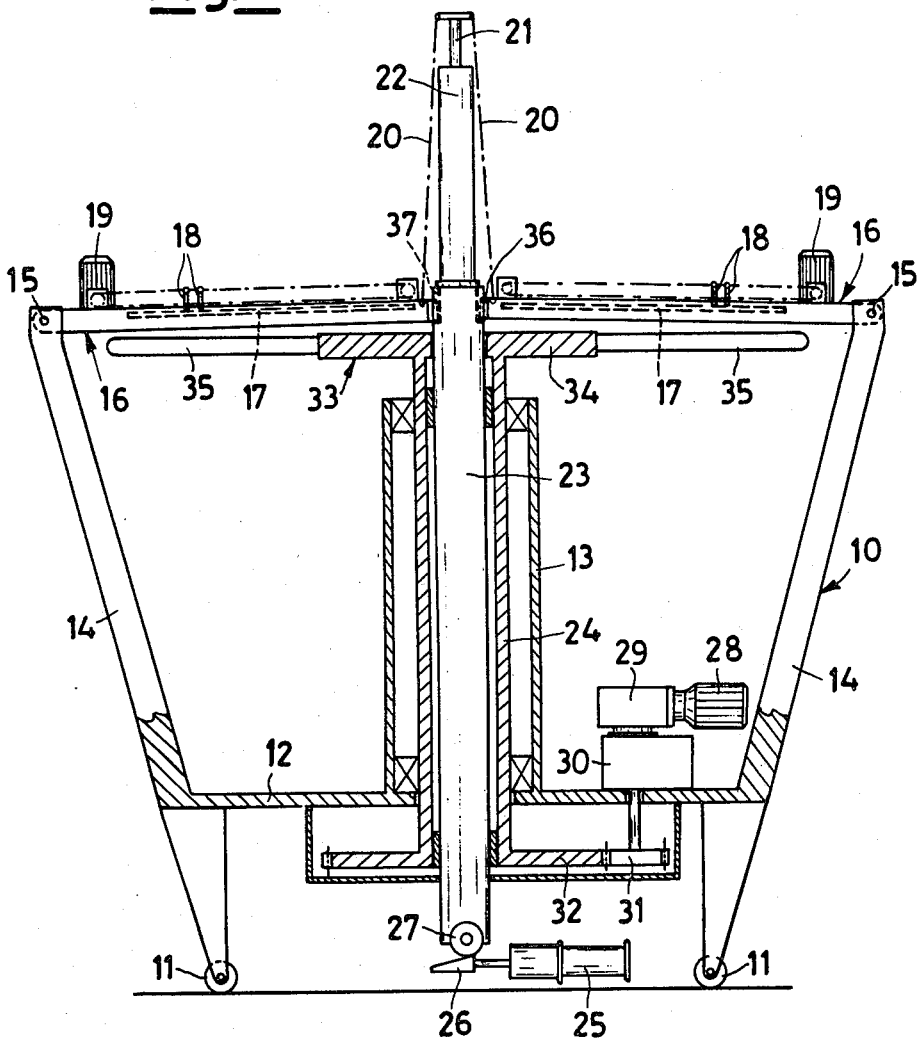

When it is desired to print, the printing screens 16 are first lowered into the position of FIG. 2 by means of retraction of the stem 21, and then into the position of FIG. 1, by retraction of the wedge 26. When they have simultaneously printed all the fabric garments, the printing screens 16 are raised to the position of FIG. 2 and the carousel is moved forward one step so as to bring each garment below the next, which is lowered for the printing of a different colour, and so on until completion of the printing on each fabric garment by means of the use of all the printing screens 16. A stable operating position for each printing screen 16 is assured by a stanchion 36 which is fitted into a respective groove 37 in the shaft 23.

It is thus seen that each finished fabric garment can be fitted onto the forms 35 in a perfectly centered position and in a stable condition, so that the printing on it is performed in the exact position desired.

The number of printing screens and related forms will of course depend on the various colours composing the printing to be carried out.

The scope of the invention is therefore defined by the following claims.

We claim:

1. In an automatic apparatus for printing fabrics, particularly finished garments, of the type provided with a plurality of printing screens which are lowered and raised with respect to a rotatable garment support member, the improvement comprising a substantially horizontal base member bounded by a peripheral outer region, support arms extending upwardly from the outer peripheral region of said base member, a hollow cylindrical column extending substantially vertically upwardly from the central region of said base member, a tubular outer shaft extending through said column and rotatably supported coaxially therein, a polygonal radial flange mounted at the top of said outer shaft, forms for mounting the garments to be printed removably supported on and radially extending from edges of said flange means at the lower end of said outer shaft to rotate said outer shaft in predetermined stepwise fashion to move said forms between successive printing positions, a plurality of printing screens radially oriented relative to said outer shaft and pivotally mounted at their outermost ends to the upper ends of said support arms and extending radially inwardly therefrom to overly said forms in the printing position, an inner shaft coaxially supported within said outer shaft for relative axial movement with respect thereto and extending through the lower end and through said flange at the upper end thereof, cam means mounted on said base member operably engaging the lower end of said inner shaft to raise and lower it a predetermined amount, a hydrodynamic piston and cylinder means mounted on the upper end of said inner shaft and extending coaxially upwardly therefrom, a piston rod attachwed to said piston and extending upwardly, flexible cable members each connected at one end to an upper end of said piston rod and at the other end to a respective one of said printing screens, said inner shaft and said piston and cylinder means operating cooperatively so that raising of said inner shaft by said cam means raises said printing screens simultaneously from the printing position an incremental amount to allow rotation of said forms between said successive printing positions, and extension of said piston rod raises said printing screens a substantially greater amount about their outer pivoted ends to allow access to said screens for replacement thereof and for servicing the apparatus.

2. An apparatus according to claim 1 wherein said inner shaft has a plurality of axially extending circumferentially spaced grooves in the outer surface at the upper end thereof, and stanchions are provided extending radially inwardly from the printing screens, said stanchions removably engaging at their innermost ends with said grooves for stabilizing said screens in the proper position for printing.

* * * * *